US009201363B2

(12) United States Patent
Fukunaga et al.

(10) Patent No.: US 9,201,363 B2
(45) Date of Patent: Dec. 1, 2015

(54) FIXING DEVICE AND IMAGE FORMING APPARATUS

(71) Applicant: KYOCERA Document Solutions Inc., Osaka-shi, Osaka (JP)

(72) Inventors: Yasuyuki Fukunaga, Osaka (JP); Teruyuki Miyamoto, Osaka (JP)

(73) Assignee: KYOCERA Document Solutions Inc. (JP)

( * ) Notice: Subject to any disclaimer, the term of this patent is extended or adjusted under 35 U.S.C. 154(b) by 0 days.

(21) Appl. No.: 14/604,909

(22) Filed: Jan. 26, 2015

(65) Prior Publication Data

US 2015/0212466 A1 Jul. 30, 2015

(30) Foreign Application Priority Data

Jan. 28, 2014 (JP) ..... 2014-013083

(51) Int. Cl.
*G03G 15/20* (2006.01)
*G03G 15/00* (2006.01)

(52) U.S. Cl.
CPC ..... *G03G 15/2053* (2013.01); *G03G 15/2085* (2013.01); *G03G 15/2035* (2013.01); *G03G 2221/1657* (2013.01)

(58) Field of Classification Search
CPC ..... G03G 15/2053; G03G 15/2085; G03G 15/2028; G03G 15/2039; G03G 21/1647; G03G 2215/2035
USPC ..... 399/122, 320, 322, 328
See application file for complete search history.

(56) References Cited

U.S. PATENT DOCUMENTS

| | | | | |
|---|---|---|---|---|
| 8,225,756 | B2 * | 7/2012 | Schoen et al. | 123/90.16 |
| 2007/0119280 | A1 | 5/2007 | Takahashi | |
| 2009/0060613 | A1 | 3/2009 | Matsuda et al. | |
| 2011/0069984 | A1 * | 3/2011 | Watanabe | 399/67 |
| 2012/0263487 | A1 * | 10/2012 | Itaya | 399/68 |
| 2013/0071152 | A1 | 3/2013 | Fujiwara et al. | |
| 2013/0206745 | A1 | 8/2013 | Tanaka et al. | |

FOREIGN PATENT DOCUMENTS

JP 2001-201976 7/2001

OTHER PUBLICATIONS

European Appl. No. 15000235.0—European Search Report issued Aug. 28, 2015.

* cited by examiner

*Primary Examiner* — Walter L Lindsay, Jr.
*Assistant Examiner* — Jessica L Eley
(74) *Attorney, Agent, or Firm* — Gerald E. Hespos; Michael J. Porco; Matthew T. Hespos

(57) ABSTRACT

A fixing device includes first and second rollers, a pressure adjustment mechanism, a drive input gear, a ratchet mechanism, and a transmission mechanism. The pressure adjustment mechanism changes a pressing posture of the first and second rollers. The drive input gear device receives a torque of a first rotational direction around an axis of the gear device and another toque of a second rotational direction. The ratchet mechanism, when the drive input gear device receives the torque of the first rotational direction, transmits the torque to the first roller, and in the case of the torque of the second rotational direction, suspends a torque transmission. When the drive input gear device receives the torque of the second rotational direction, the transmission mechanism exerts a driving force to the pressure adjustment mechanism. The drive input gear device includes a housing portion housing a part of the ratchet mechanism.

5 Claims, 14 Drawing Sheets

FIXING DEVICE AND IMAGE FORMING APPARATUS

INCORPORATION BY REFERENCE

This application is based on Japanese Patent Application No. 2014-13083 filed with the Japan Patent Office on Jan. 28, 2014, the contents of which are hereby incorporated by reference.

BACKGROUND

The present disclosure relates to a fixing device for fixing a toner image on a sheet, and an image forming apparatus including the fixing device.

A fixing device of an image forming apparatus includes a fixing nip defined by a fixing roller and a pressing roller brought in pressed contact with each other. A sheet passes through the fixing nip where the sheet is pressed and heated to thereby allow a toner image on the sheet to be fixed thereon. There is known a fixing device including a pressure adjustment mechanism for adjusting a pressure contact force (nip pressure) in the fixing nip. The pressure adjustment mechanism makes it possible to set the nip pressure to an appropriate value according to the thickness of a sheet and, when the fixing device is not used, to release the nip pressure to thereby prevent distortion of the fixing roller due to its pressed contact.

Such a fixing device as described above needs to include a drive system for the fixing roller and a drive system for the pressure adjustment mechanism, the two drive systems being controllable independently of each other. Each of the drive systems is preferred to include a drive motor. However, in many cases, a single drive motor is used to drive the both drive systems for the purpose of reducing the number of components. In this case, the single drive motor rotates a driving input gear which is common to the both drive systems in a forward direction or a reverse direction, so that one of the drive system for the fixing roller and the drive system for the pressure adjustment mechanism is driven. Such a configuration requires a mechanism for transmitting only a torque of a specific direction selectively to one of the drive systems. In the above-described fixing device, a one-way clutch is used.

The one-way clutch is functionally satisfactory but is relatively expensive and is, therefore, desirably avoided for use. As an alternative to the one-way clutch, there are a ratchet mechanism and a planetary gear mechanism.

SUMMARY

A fixing device according to an aspect of the present disclosure includes first and second rollers defining a fixing nip, a pressure adjustment mechanism, a drive input gear device, a ratchet mechanism, and a transmission mechanism.

The pressure adjustment mechanism performs posture change of changing from a first posture where the first and second rollers are in pressed contact with each other at a first pressure to a second posture where the first and second rollers are in pressed contact with each other at a second pressure lower than the first pressure, and vice versa. The drive input gear device receives a torque of a first rotational direction around an axis of the gear device and another torque of a second rotational direction opposite to the first direction. When the drive input gear device receives the torque of the first rotational direction, the ratchet mechanism transmits the torque of the first rotational direction to the first roller, and when the drive input gear device receives the torque of the second rotational direction, the ratchet mechanism suspends a torque transmission to the first roller. When the drive input gear device receives the torque of the second rotational direction, the transmission mechanism exerts a driving force to the pressure adjustment mechanism to thereby allow the posture change. The drive input gear device includes a housing portion housing a part of the ratchet mechanism.

An image forming apparatus according to another aspect of the present disclosure includes an image forming section for transferring a toner image onto a sheet, and the above-described fixing device for fixing the toner image on the sheet.

These and other objects, features and advantages of the present disclosure will become more apparent upon reading the following detailed description along with the accompanying drawings.

DETAILED DESCRIPTION

Figure 1:
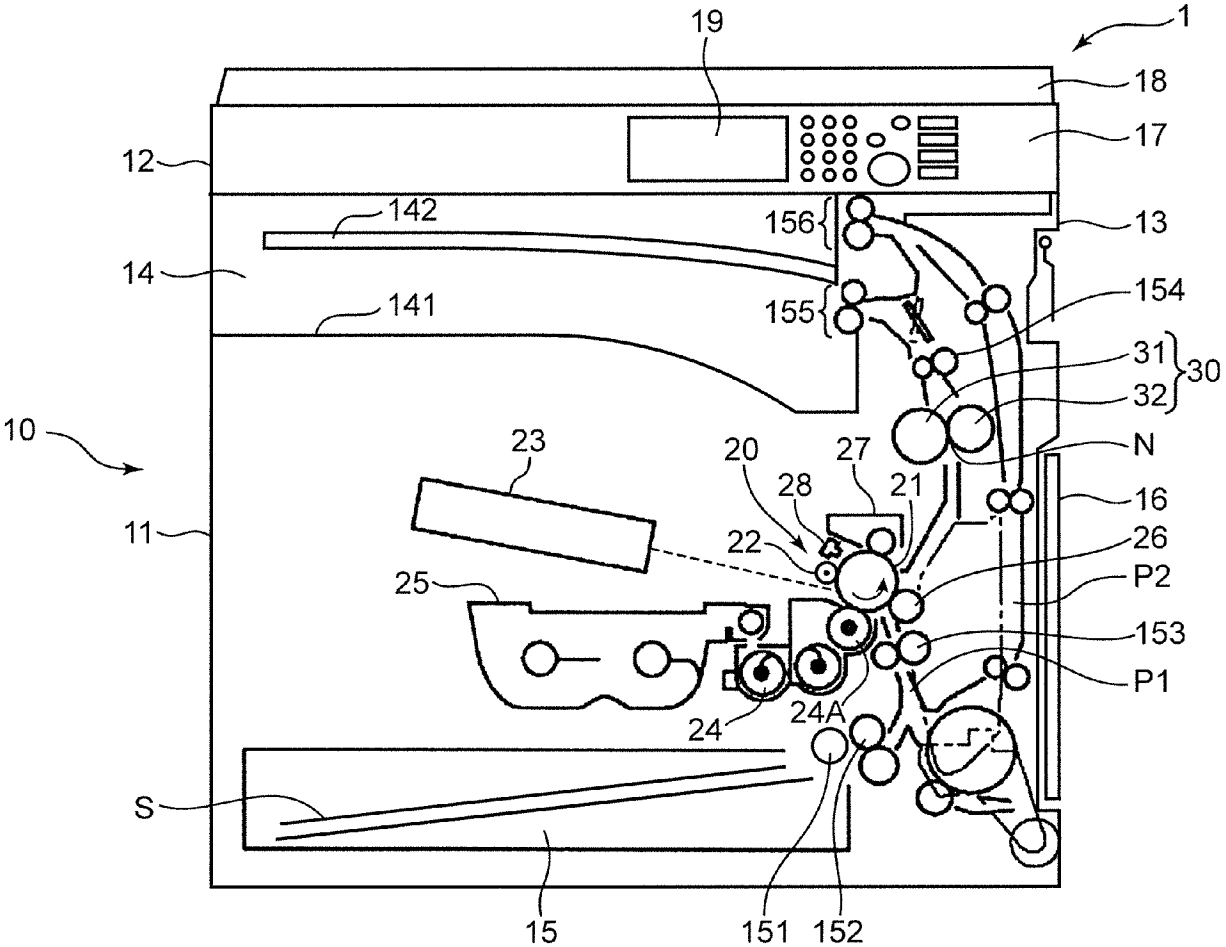
FIG. 1 is a schematic sectional view showing an overall configuration of an image forming apparatus according to an embodiment of the present disclosure.

Hereinafter, an embodiment of the present disclosure will be described in detail with reference to the accompanying drawings. FIG. 1 is a sectional view showing an internal structure of an image forming apparatus 1 according to an embodiment of the present disclosure. The image forming apparatus 1 is configured as a printer with a monochrome copying function, and includes an apparatus body 10 in the form of a housing having a substantially cuboid shape. The apparatus body 10 houses various components that perform image formation on a sheet. The apparatus body 10 includes a body housing 11 having a substantially cuboid shape, a scanner housing 12 disposed on the body housing 11 and having a substantially cuboid shape, and a connecting housing 13 connecting the housings 11 and 12.

The body housing 11 houses an image forming section 20 for transferring a toner image onto a sheet. The connecting housing 13 houses a fixing device 30 for fixing a toner image on a sheet. The scanner housing 12 houses a scanner unit 17 for optically reading an image formed on an original document sheet and generating image data. A top surface of the body housing 11, a bottom surface of the scanner housing 12, and a left surface of the connecting housing 13 define an in-body cavity which serves as an in-body sheet receiving section 14 for receiving a sheet that is discharged thereto after being subjected to image formation.

The connecting housing 13 includes a first sheet discharge port 155 which is disposed in a right portion of the apparatus body 10 and opened to the cavity for discharging a sheet to the in-body sheet receiving section 14, and a second sheet discharge port 156 which is disposed above the first sheet discharge port 155 and opened to the cavity in the same way as the first sheet discharge port 155. The bottom of the cavity is defined by an in-body sheet receiving tray 141. The in-body sheet receiving tray 141 receives a sheet discharged from the first sheet discharge port 155. A sub-sheet receiving tray 142 is mounted between the first sheet discharge port 155 and the second sheet discharge port 156. The sub-sheet receiving tray 142 receives a sheet discharged from the second sheet discharge port 156, or temporarily receives a sheet to be subjected to double-sided printing for switchback conveyance.

A sheet feed cassette 15 is detachably mounted in a lower portion of the apparatus body 10 for storing sheets S that are to be subjected to image formation. A manual feed tray 16 is provided on a right side of the apparatus body 10, the manual feed tray being used when a sheet is manually fed.

The image forming section 20 includes a photoconductive drum 21, and a charging device 22, an exposure device 23, a developing device 24, a transferring roller 26, a cleaning device 27 and a static eliminator 28 disposed around the photoconductive drum 21. The photoconductive drum 21 rotates around its axis and has a circumferential surface to be formed with an electrostatic latent image and a toner image. The charging device 22 uniformly charges the circumferential surface of the photoconductive drum 21. The exposure device 23 irradiates the circumferential surface of the photoconductive drum 21 with beams of laser light in order to form an electrostatic latent image. The developing device 24 includes a developing roller 24A for supplying toner to the circumferential surface of the photoconductive drum 21 in order to develop an electrostatic latent image formed on the photoconductive drum 21. The developing device 24 is supplied with toner from a toner container 25. The transferring roller 26 defines a transfer nip in cooperation with the photoconductive drum 21 and transfers a toner image on the photoconductive drum 21 onto a sheet. The cleaning device 27 cleans the circumferential surface of the photoconductive drum 21 after a toner image is transferred from the circumferential surface. The static eliminator 28 irradiates the circumferential surface of the photoconductive drum 21 with static eliminating light after a toner image is transferred from the circumferential surface to thereby remove the remaining charged electricity from the circumferential surface.

The fixing device 30 includes a fixing roller 31 (first roller) having a built-in heating source, and a pressing roller 32 (second roller) defining a fixing nip N in cooperation with the fixing roller 31. The fixing device 30 performs fixing processing of heating and pressing a sheet at the fixing nip N, the sheet having a toner image transferred thereon at the transfer nip, to thereby fuse the toner onto the sheet. The sheet having been subjected to the fixing processing is discharged to the in-body sheet receiving section 14 from the first sheet discharge port 155 or the second sheet discharge port 156. The fixing device 30 will be described in detail later.

The scanner unit 17 placed in the scanner housing 12 includes an unillustrated carriage having an imaging device, a light source for irradiating an original document sheet with beams of light, and a mirror for guiding beams of light reflected from the document sheet to the imaging device. A contact glass is fitted in a top portion of the scanner unit 17, the glass for allowing an original document sheet to be placed thereon. Further, a top surface of the scanner unit 17 is covered by a pressing cover 18 for pressing an original document sheet placed on the contact glass. An operation panel 19 is mounted on a front surface of the scanner housing 12. The operation panel 19 includes an LCD touch panel, a numerical keypad, and the like for allowing a user to input various types of operation information to the image forming apparatus 1.

In the apparatus body 10, a sheet conveyance passage for allowing passage of a sheet therethrough is provided. The sheet conveyance passage includes a main conveyance passage P1 extending vertically from a lower portion to an upper portion of the apparatus body 10 through the image forming section 20 and the fixing device 30. The main conveyance passage P1 has downstream ends respectively joining the first sheet discharge port 155 and the second sheet discharge port 156. A reverse conveyance passage P2 extends from the most downstream end to the vicinity of an upstream end of the main conveyance passage P1, the reverse conveyance passage for allowing reverse conveyance of a sheet for double-sided printing.

The sheet feed cassette 15 includes a sheet storage portion for storing a stack of sheets S therein. Near an upper right corner of the sheet feed cassette 15, there are provided a pickup roller 151 for picking up the sheets S one by one from the top of the stack of sheets, and a pair of sheet feeding rollers 152 for feeding a picked-up sheet to the upstream end of the main conveyance passage P1. A sheet placed on the manual feed tray 16 is also fed to the upstream end of the main conveyance passage P1. At an upstream side of the image forming section 20 in the main conveyance passage P1, there is disposed a pair of register rollers 153 for feeding a sheet to the transfer nip at a predetermined timing.

In the case of single-sided printing (image formation), a sheet S is fed from the sheet feed cassette 15 or the manual feed tray 16 to the main conveyance passage P1 to be subsequently subjected to the toner image transfer processing at the image forming section 20, and then subjected to the fixing processing of the transferred toner on the sheet S at the fixing device 30. Afterwards, the sheet S is discharged onto the in-body sheet receiving tray 141 from the first sheet discharge port 155. On the other hand, in the case of both-sided printing, after one side of a sheet S is subjected to the transfer processing and the fixing processing, a part of the sheet S is discharged onto the sub-sheet receiving tray 142 from the second sheet discharge port 156. Afterwards, the sheet S is returned to the vicinity of the upstream end of the main conveyance passage P1 by the way of the reverse conveyance passage P2 in the manner of switchback. Thereafter, the other side of the sheet S is subjected to the transfer processing and the fixing processing, and the sheet S is then discharged onto the in-body sheet receiving tray 141 from the first sheet discharge port 155.

Figure 2:
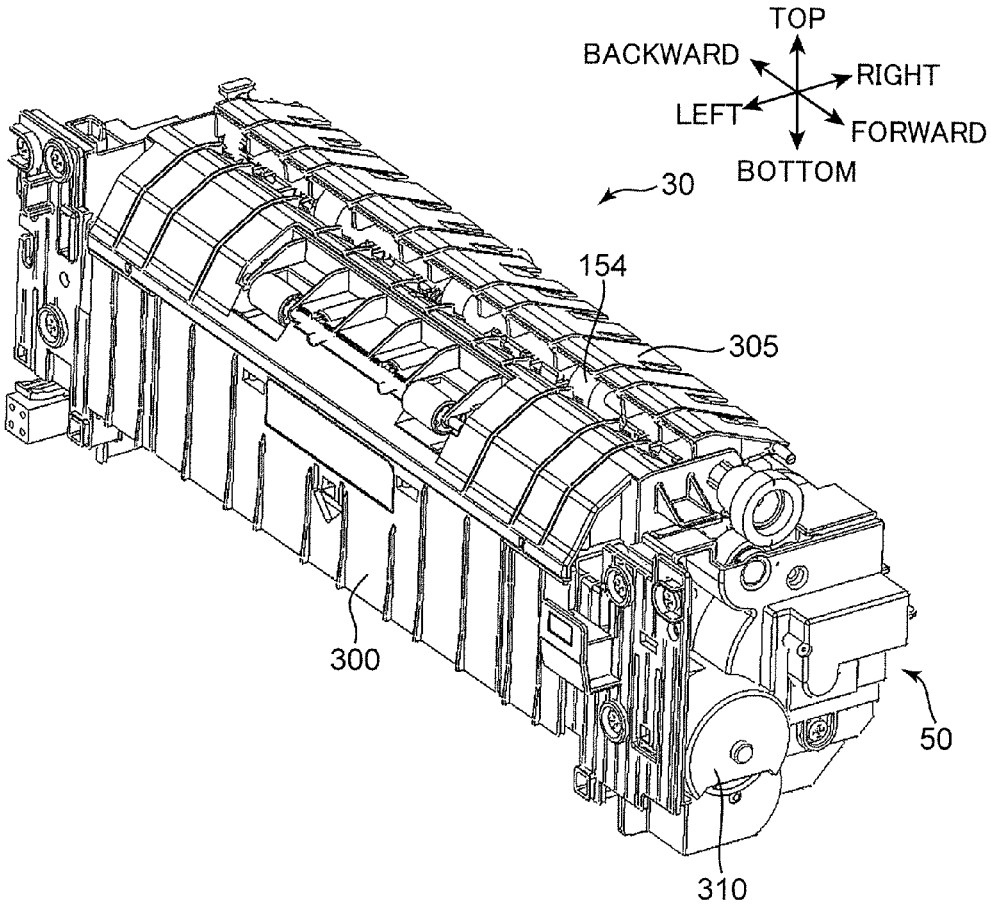
FIG. 2 is a perspective view of a fixing device incorporated in the image forming apparatus.
Figure 3:
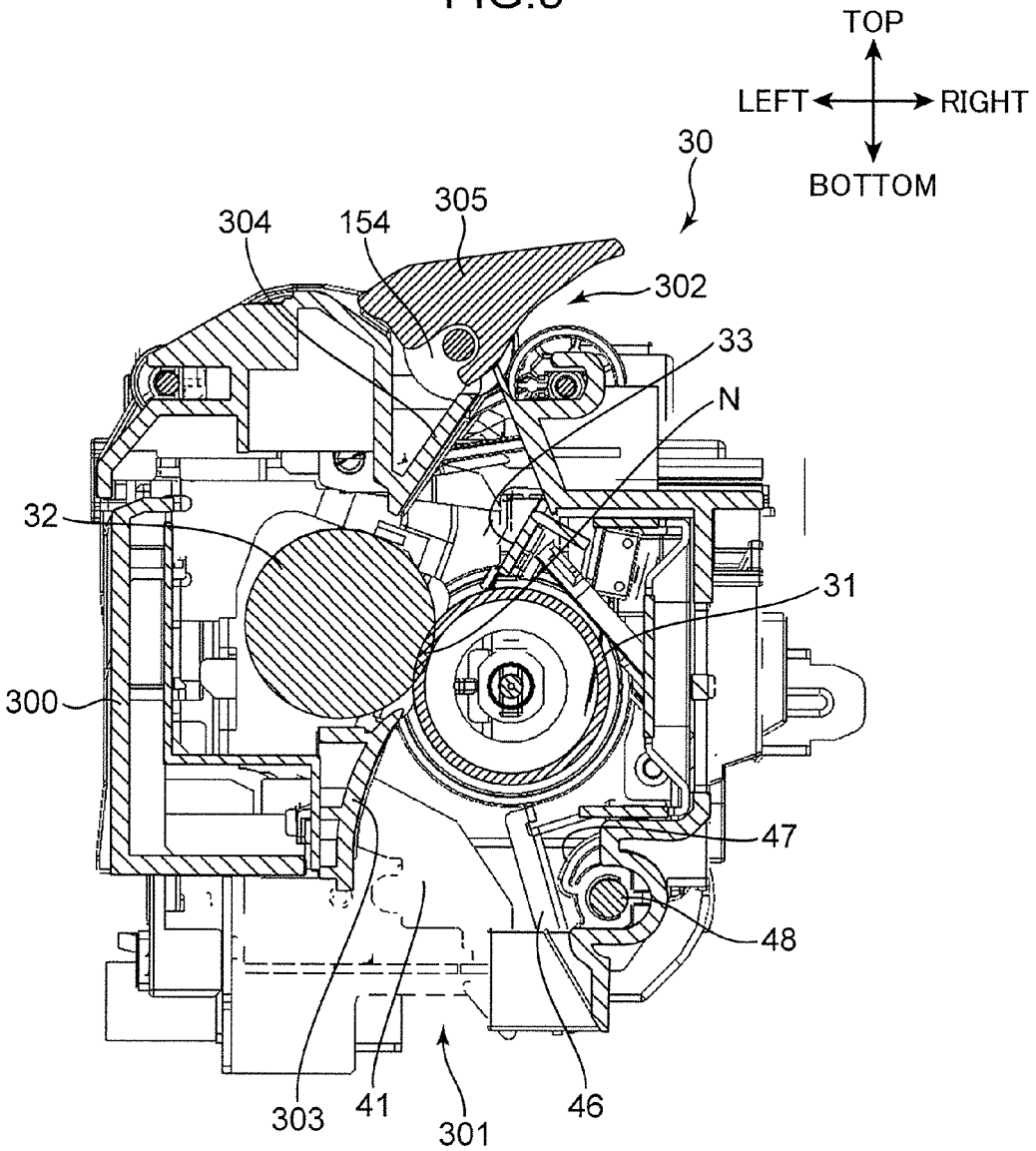
FIG. 3 is a sectional view of the fixing device.

Hereinafter, a configuration of the fixing device 30 will be described in detail. FIG. 2 is a perspective view of the fixing device 30, and FIG. 3 is a sectional view of the fixing device 30 taken in a left-right direction. The fixing device 30 includes a fixing housing 300 housing the above-described fixing roller 31 and pressing roller 32. The fixing housing 300 includes an inlet opening 301 for receiving a sheet from the image forming section 20, and an outlet opening 302 for discharging a sheet having been subjected to the fixing processing. An upstream guide plate 303 is disposed downstream of the inlet opening 301, the upstream guide plate for guiding a sheet to the fixing nip N. A downstream guide plate 304 is disposed upstream of the outlet opening 302, the downstream guide plate for guiding a sheet having passed through the fixing nip N. Near the outlet opening 302, there are disposed a sheet conveying roller 154, and a movable guide member 305 having a sheet guiding function.

The fixing roller 31 is in the form of a metallic cylindrical roller and includes a built-in halogen heater as a heating element. The pressing roller 32 is in the form of a roller and includes an elastic layer made of elastic rubber and the like. The pressing roller 32 is pressed against the fixing roller 31 at a predetermined pressure to thereby allow the elastic layer to be deformed to define the fixing nip N having a predetermined width. In the present embodiment, the fixing roller 31 receives a torque around an axis thereof, and the pressing roller 32 is driven to rotate around an axis thereof by rotation of the fixing roller 31. A sheet separating member 33 is disposed downstream of the fixing nip N in a rotational direction of the fixing roller 31. The separating member 33 prevents a sheet having passed through the fixing nip N from wrapping around the circumferential surface of the fixing roller 31.

On a front surface of the fixing housing 300, there are mounted a drive motor 310 configured as a stepping motor, and a gear transmission mechanism 50 including a plurality of gears. The drive motor 310 generates a torque to rotate the fixing roller 31. The gear transmission mechanism 50 functions to transmit a torque generated by the drive motor 310 to the fixing roller 31 and to transmit the torque to a pair of nip pressure adjustment mechanisms 40 described later.

Figure 4:
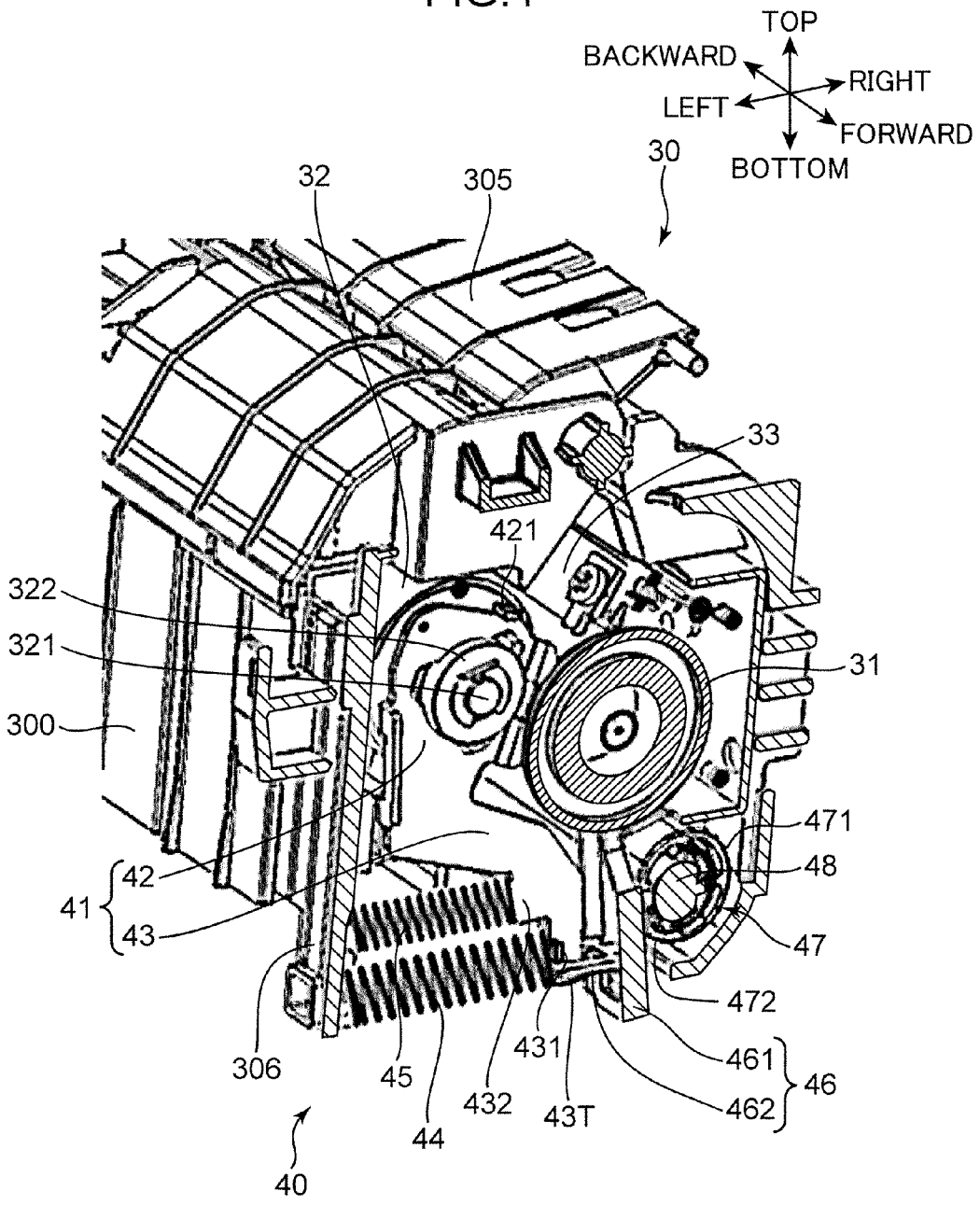
FIG. 4 is a perspective view showing a nip pressure adjusting mechanism of the fixing device.

FIG. 4 is a perspective view showing the nip pressure adjustment mechanism 40. The nip pressure adjustment mechanism 40 changes a nip pressure of the fixing nip N from a normal pressure level to a low pressure level and vice versa. Specifically, the nip pressure adjustment mechanism 40 performs posture change of changing from a first posture where the fixing roller 31 and the pressing roller 32 are in pressed contact with each other at a predetermined first pressure to a second posture where the fixing roller 31 and the pressing roller 32 are in pressed contact with each other at a second pressure lower than the first pressure, and vice versa. In the present embodiment, the fixing roller 31 serving as a driving roller is stationary, and the pressing roller 32 serving as a driven roller is moved to thereby perform the posture change.

In a normal pressure state with the normal pressure level (in the first posture), the pressing roller 32 is in pressed contact against the fixing roller 31 with the fixing nip N having such a nip width in a sheet conveyance direction as to allow a sheet having a normal thickness to be subjected to the fixing processing. On the other hand, in a low pressure state with the low pressure level (in the second posture), the pressing roller 32 is more distant from the fixing roller 31 with the fixing nip N having a shorter nip width than in the normal pressure state, the low pressure state being selected to perform the fixing processing on a thick sheet or an envelope and to remove a jammed sheet.

Each of the nip pressure adjustment mechanisms 40 includes a pressing plate 41, a first pressing spring 44, a second pressing spring 45, a lever 46, a cam 47, and a cam shaft 48 (cam mechanism). The nip pressure adjustment mechanisms 40 are respectively disposed in front and rear ends of the fixing roller 32 and the pressing roller 32, although only the front one is shown in FIG. 4. Hereinafter, description will be made on the front nip pressure adjustment mechanism 40.

The pressing plate 41 rotatably holds the pressing roller 32, and is pivotable to achieve the posture change. The pressing plate 41 includes a body portion 42 holding the pressing roller 32, and a leg portion 43 extending downward from the body portion 42 for receiving a pressing force from either of the first pressing spring 44 and the second pressing spring 45. A bearing 322 is mounted on the main portion 42, the bearing rotatably supporting an end of a rotary shaft 321 of the pressing roller 32. The leg portion 43 is, in front view, in the shape of L having a substantially horizontal part extending rightward from a lower portion of the main portion 42, and a vertical part extending downward from a right end of the horizontal part. The leg portion 43 includes a first pressure receiving region 431 located on a lower end of the vertical part, and a second pressure receiving region 432 located above and further leftward than the first pressure receiving region 431 in the vertical part. The first pressure receiving region 431 and the second pressure receiving region 432 are defined by a left end surface of the vertical part, the first and second receiving parts facing a base frame 306 of the fixing housing 300.

Figure 5:
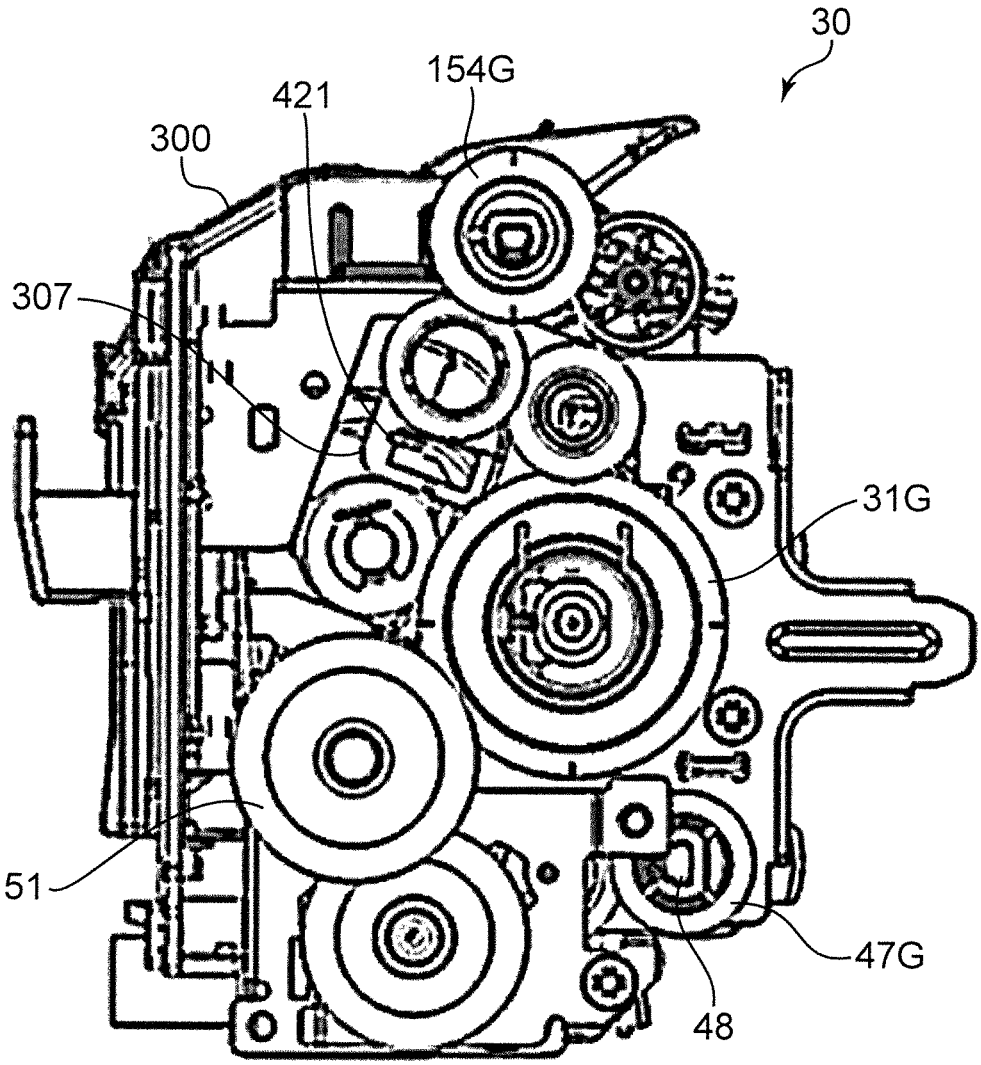
FIG. 5 is a side view of the fixing device.

A locking portion 421 in the form of a hook is disposed on an upper edge of the main portion 42, the locking portion projecting forward. The locking portion 421 serves as a pivot of the pressing plate 41. FIG. 5 is a side view of the fixing device 30. On a front plate of the fixing housing 300, a support frame 307 having a rectangular opening is provided. The locking portion 421 is fitted on an edge of the opening formed in the support frame 307, and moves in a vertical direction. This is to displace the position of the locking portion 421 serving as the pivot of the pressing plate 41 according to a pivotal movement of the pressing plate 41, to thereby keep the pressing roller 32 abutting the fixing roller 32 at the same angle even when the posture change is performed.

The first pressing spring 44 and the second pressing spring 45 are in the form of a coil spring and expand and contract in a left-right direction, the first and second pressing springs being disposed vertically in parallel to each other. The first pressing spring 44 is disposed between the first pressure receiving region 431 of the pressing plate 41 and the base frame 306, and the second pressing spring 45 is disposed between the second pressure receiving region 432 and the base frame 306. In the normal pressure state, the first pressing spring 44 presses the pressing plate 41, and in the low pressure state, the second pressing spring 45 presses the pressing plate 41. The second pressing spring 45 has a spring force weaker than the first pressing spring 44, and a spring length shorter than the first pressing spring 44 by the length of projection of the second pressure receiving region 432.

The lever 46 allows selection as to which of the first pressing spring 44 and the second pressing spring 45 is caused to press the pressing plate 41. The lever 46 includes a cam abutting plate 461, and a fitting piece 462 projecting leftward from a left surface of the cam abutting plate 461. The cam abutting plate 461 is in the form of a flat plate and has a pivot (not shown in FIG. 4) at an upper portion thereof. A circumferential surface of the cam 47 is brought into contact with a right surface of the cam abutting plate 461. The fitting piece 462 includes a long hole having a longer dimension in the left-right direction and allowing a lower end 43T of the pressing plate 41 to fit therein. A left end of the fitting piece 462 is in contact with a right end of the first pressing spring 44. The first pressing spring 44 exerts a pressing force to the first pressure receiving region 431 of the pressing plate 41 via the fitting piece 462.

The cam 47 includes a long radius part 471 and a short radius part 472 which are on a circumferential surface of the cam 47. The cam shaft 48 is in the form of a rotary shaft and extends in a front-rear direction, and the cam 47 is integrally mounted on a shaft end of the cam shaft 48. The cam 47 is disposed to the right of the lever 46. The cam shaft 48 receives a torque around an axis thereof to thereby cause the long radius part 471 to come into contact with the cam abutting plate 461 or cause the short radius part 472 to face the cam abutting plate 461.

Operations of the nip pressure adjustment mechanism 40 will be described with reference to FIGS. 6A and 6B. FIG. 6A is a schematic view showing the fixing nip N set at a fixing nip N1 in the normal pressure state (in the first posture). In this case, the short radius part 472 of the cam 47 faces the cam abutting plate 461 of the lever 46. There is a gap g1 between the short radius part 472 and the cam abutting plate 461, which suspends transmission of a compressive pressing force from the lever 46 to the first pressing spring 44. Therefore, the first pressing spring 44 exerts a pressing force to the first pressure receiving region 431 via the fitting piece 462 to rotate the pressing plate 41 in a counterclockwise direction around the locking portion 421 serving as the pivot. Consequently, the pressing roller 32 is brought into pressed contact with the fixing roller 31 with a relatively strong force to thereby define the fixing nip N1 having a relatively wide width. In addition, there is a gap g2 between a right end of the second pressing spring 45 and the second pressure receiving region 432, which suspends transmission of a spring force from the second pressing spring 45 to the pressing plate 41.

Figure 6B:
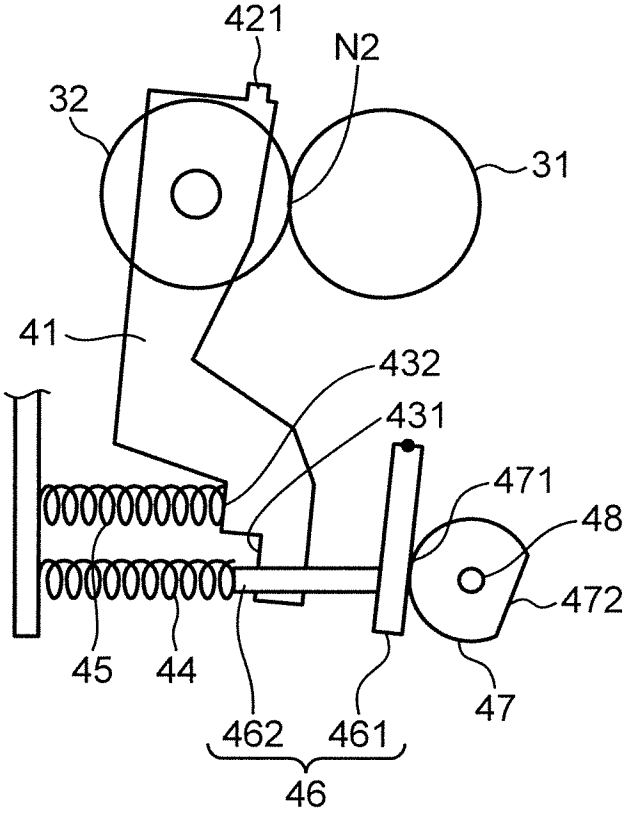
FIG. 6A and FIG. 6B are each a schematic view for explaining an operation of the nip pressure adjusting mechanism.
Figure 6A:
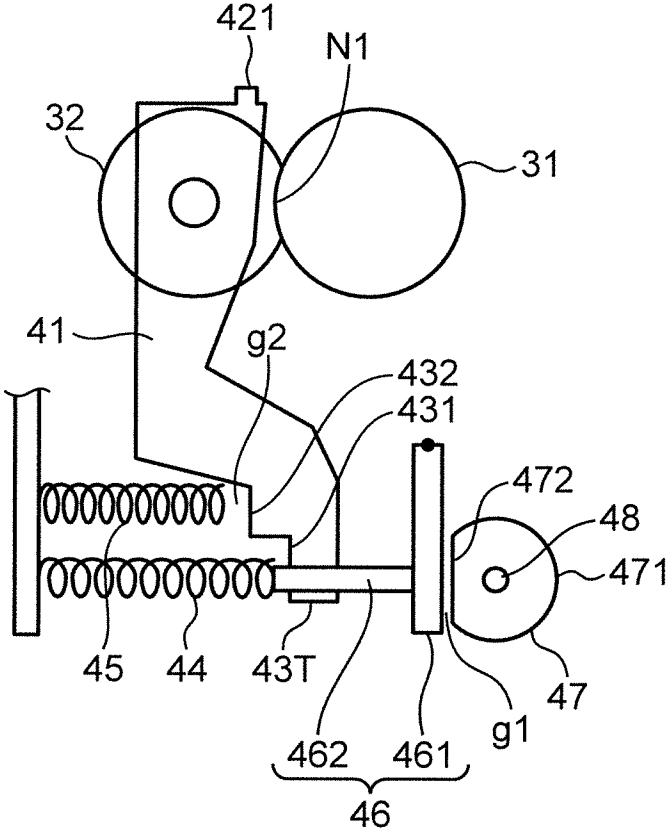

FIG. 6B is a schematic view showing the fixing nip N set at a fixing nip N2 in the low pressure state (in the second posture). In this case, the long radius part 471 of the cam 47 is in contact with the cam abutting plate 461 and the lever 46 is shifted leftward. The shift of the lever causes a left end of the locking piece 462 to press the first pressing spring 44 to thereby compress the first pressing spring 44. This releases the first pressing spring 44 from pressing against the first pressure receiving region 431. Consequently, the pressing plate 41 pivots in a clockwise direction about the locking piece 421 to allow the right end of the second pressure spring 45 to come into contact with the second pressure receiving region 432. In other words, a pressing force of the second pressing spring 45 begins to be transmitted to the pressing plate 41. This operation brings the pressing roller 32 into pressed contact with the fixing roller 31 with a relatively small force to thereby define the fixing nip N2 having a relatively narrow width.

Figure 7:
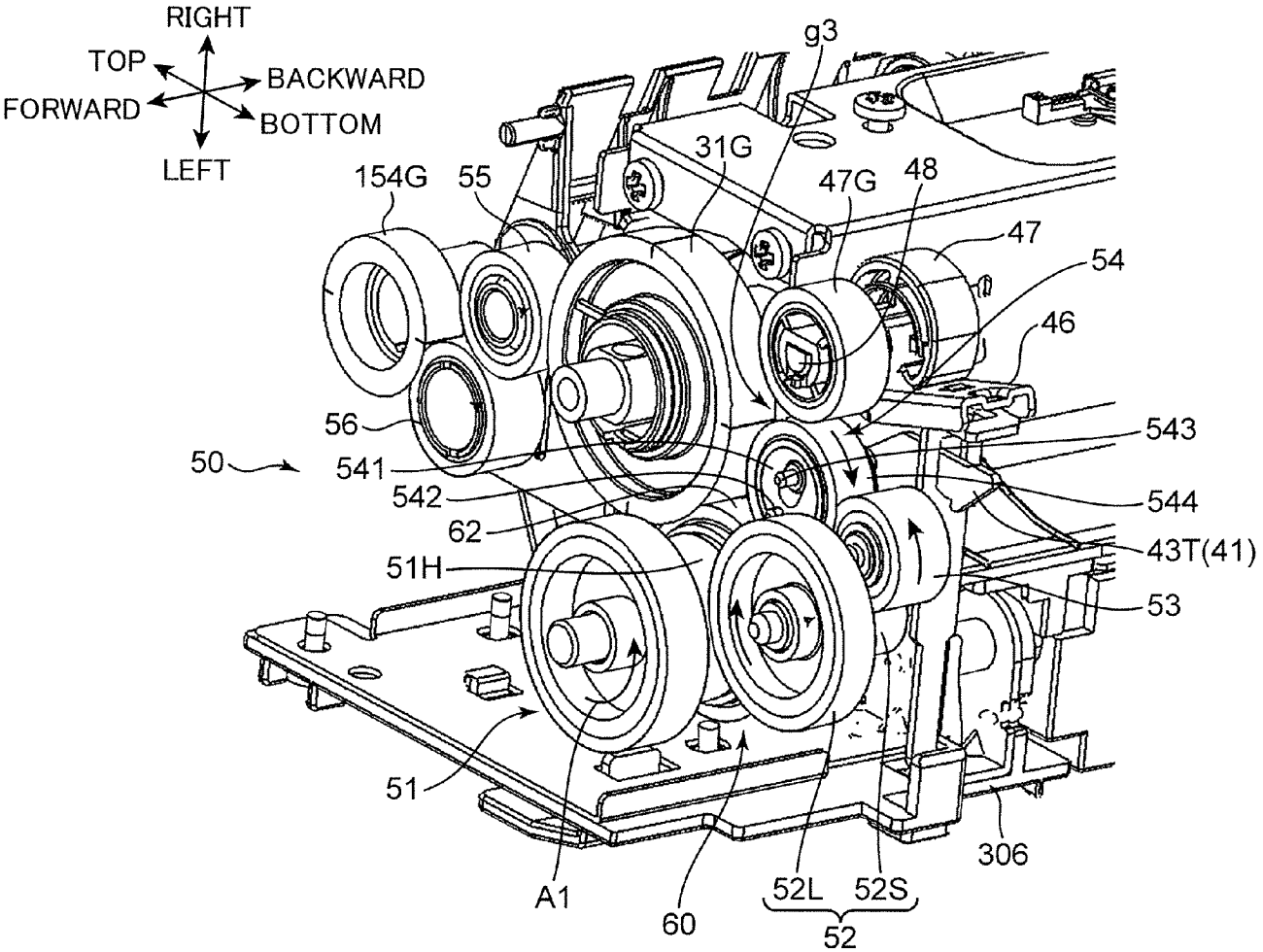
FIG. 7 is a perspective view showing a gear transmission mechanism of the fixing device.

Now the gear transmission mechanism 50 will be described in detail. FIG. 7 is a perspective view showing the gear transmission mechanism 50. The gear transmission mechanism 50 includes a fixing roller drive system for transmitting a torque of the drive motor 310 to the fixing roller 31, and a nip pressure adjustment drive system (transmission mechanism) for transmitting the torque to the cam shaft 48 of the above-described nip pressure adjustment mechanism 40. The fixing roller drive system of the gear transmission mechanism 50 includes a driving input gear device 51 and a ratchet mechanism 60. The nip pressure adjustment drive system of the gear transmission mechanism 50 includes the drive input gear device 51, a first idle gear 52 (first transmitting gear), a second idle gear 53, and a moving gear 54 (second transmitting gear). The driving input gear device 51 is common to the both drive systems.

The drive input gear device 51 receives a torque generated by the drive motor 310. The drive motor 310 generates a forward torque directing in a forward direction and a backward torque directing in a backward direction. The drive motor 310 is controlled by an unillustrated motor driver so as to generate the forward torque in order to actuate the fixing roller drive system and generate the backward torque in order to actuate the nip pressure adjustment drive system. In the present embodiment, when the drive motor 310 generates the forward torque, the driving input gear device 51 rotates around an axis of the gear device in a counterclockwise direction (in a first direction; in the direction of an arrow A1 shown in FIG. 7). On the other hand, when the drive motor 310 generates the backward torque, the driving input gear device 51 rotates in a clockwise direction (in a second direction; in the direction of an arrow A2 shown in FIGS. 9 and 10).

A roller gear 31G is mounted on an end of the fixing roller 31 for transmitting a torque to the fixing roller 31 for rotation around an axis thereof. The driving input gear device 51, when the fixing roller drive system is actuated, imparts a torque to the roller gear 31G via the ratchet mechanism 60 to rotate the fixing roller 31. The ratchet mechanism 60 is coaxially mounted on the driving input gear device 51 so that a ratchet gear 62 meshes with the roller gear 31G. The ratchet mechanism 60 functions to transmit the torque to the roller gear 31G (fixing roller 31) when the drive input gear device 51 receives the counterclockwise torque, and to suspend a torque transmission to the roller gear 31G when the drive input gear device 51 receives the clockwise torque. The ratchet mechanism 60 will be described in detail with reference to FIGS. 12 to 14 later.

A roller gear 154G is mounted on an end of the sheet conveying roller 154 for transmitting a torque to the sheet conveying roller 154 for rotation around an axis thereof. The roller gear 154G receives a torque from the roller gear 31G via a third idle gear 55 and a fourth idle gear 56. In other words, the sheet conveying roller 154 follows rotation of the fixing roller 31. Upon reception of the torque, the sheet conveying roller 154 sends a sheet having subjected to the fixing processing, out of the fixing housing 300.

The first idle gear 52 includes a large diameter gear 52L and a small diameter gear 52S. The driving input gear device 51 includes a housing portion 51H. The first idle gear 52 is disposed with respect to the driving input gear device 51 so that the large diameter gear 52L meshes with a transmitting gear part formed in a circumferential portion of the housing portion 51H. The second idle gear 53 is meshed with the small diameter gear 52S. The second idle gear 53 is also meshed with the moving gear 54.

The moving gear 54 includes a moving bobbin 541 in the form of a solid cylinder, and a rotary gear 544 rotatably fitted on an outer surface of the moving bobbin 541. The moving bobbin 541 includes a projecting pin 542 on a front surface thereof. The moving bobbin 541 includes a long hole passing therethrough in a forward-backward direction. A support pin 543 in the form of a solid cylinder passes through the long hole, the support pin projecting from the fixing housing 300. The moving bobbin 541 moves with respect to the support pin 543 within a length of the long hole. The moving bobbin 541 is a non-rotary member, whereas the rotary gear 544 rotates around the moving bobbin 541.

Figure 8:
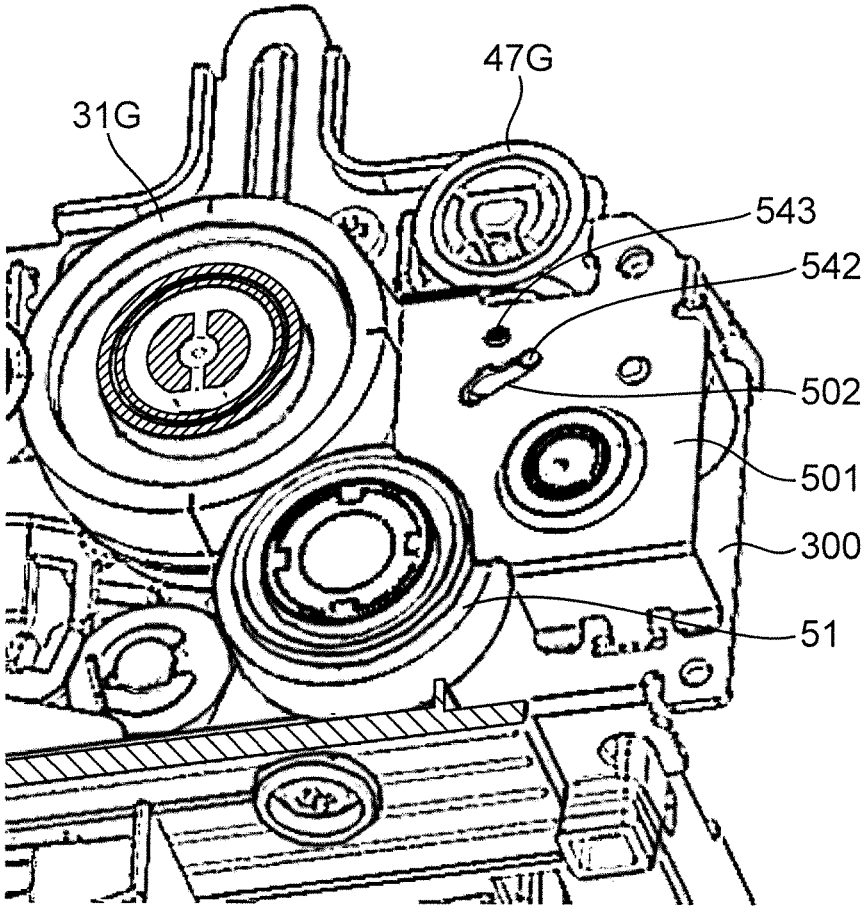
FIG. 8 is an enlarged perspective view of an essential part of the fixing device shown in the side view.

As shown in FIG. 8, the second idle gear 53 and the moving gear 54 are covered and restricted by a cover frame 501 mounted on the fixing housing 300. The cover frame 501 includes a window portion 502 in the form of a long through-hole. The projecting pin 542 of the moving bobbin 541 is fitted in the window portion 502. In addition, the cover frame 501 includes a hole in which a projection end of the support pin 543 is tightly fitted. The moving gear 54 slides in a direction according to the direction of a torque imparted from the second idle gear 53, with the projection pin 542 being guided in the window portion 502.

A cam driving gear 47G is mounted on a shaft end of the cam shaft 48. Upon receipt of a torque from the moving gear 54, the cam driving gear 47G brings the cam mechanism including the cam shaft 48 and the cam 47 into operation to thereby realize the above-described posture change operation of the pressing roller 32. The moving gear 54 meshes with the cam driving gear 47G when the driving input gear device 51 receives the clockwise torque (the direction of the arrow A2 shown in FIGS. 9 and 10), and moves in a direction of disengaging from the cam driving gear 47G when the driving input gear device 51 receives the counterclockwise torque (the direction of the arrow A1 shown in FIG. 7).

The first and second idle gears 52 and 53 follow rotation of the driving input gear device 51, irrespective of the direction of the rotation. As shown in FIG. 7, when the driving input gear device 51 rotates in the counterclockwise direction, the first idle gear 52 and the second idle gear 53 rotate in the clockwise direction and in the counterclockwise direction, respectively, and the moving gear 54 rotates in the clockwise direction. In this case, the moving gear 54 moves in the direction away from the cam driving gear 47G to define a gap g3 therebetween. Consequently, a torque transmission from the driving input gear device 51 to the cam driving gear 47G is suspended, so that the cam 47 does not rotate. Therefore, in the case where the driving input gear device 51 rotates in the counterclockwise direction, the torque is transmitted only to the roller gear 31G to thereby drive the fixing roller 31 and the sheet conveying roller 154.

Figure 9:
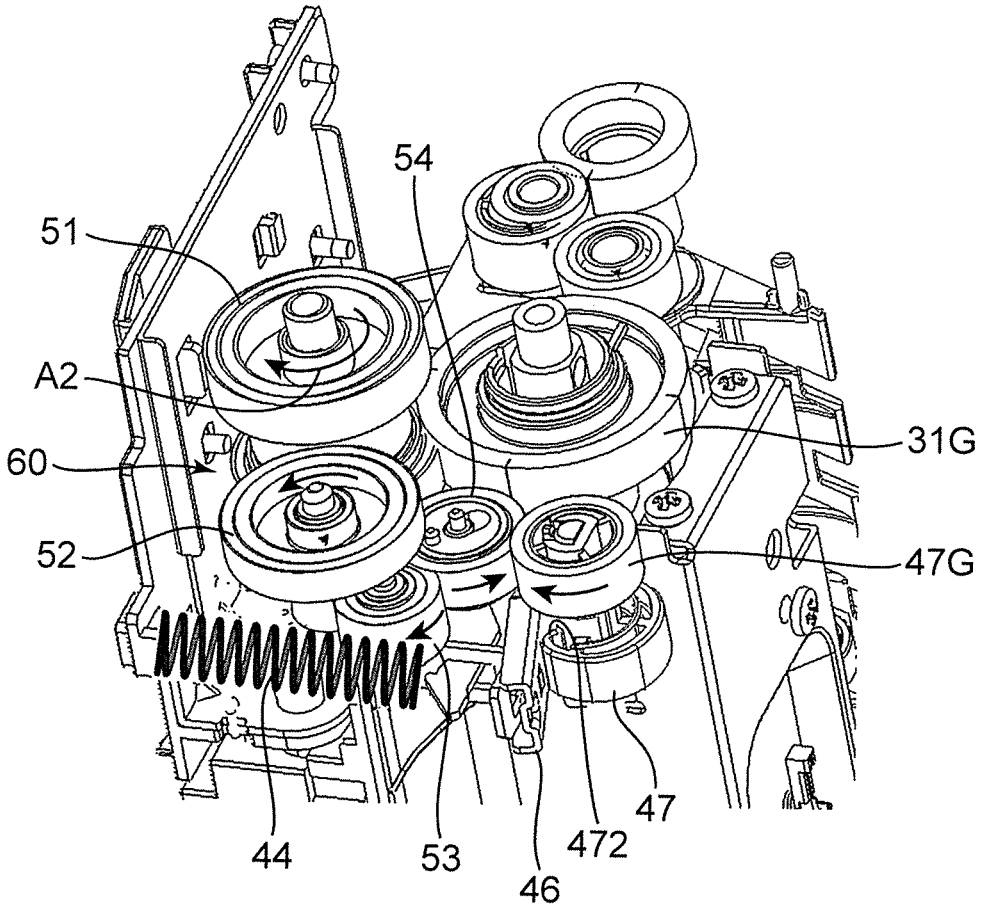
FIG. 9 is a perspective view illustrating an operation of the gear transmission mechanism.

In contrast, in the case where the driving input gear device 51 rotates in the clockwise direction as shown in FIG. 9, a torque transmission from the driving input gear device 51 to the roller gear 31G is suspended because of the operation of the ratchet mechanism 60, whereas the torque is transmitted to the cam driving gear 47G. When the driving input gear device 51 rotates in the clockwise direction, the first idle gear 52 and the second idle gear 53 rotate in the counterclockwise direction and in the clockwise direction, respectively, and the moving gear 54 rotates in the counterclockwise direction. In this case, the moving gear 54 is imparted with a lifting force generated by its rotation in the counterclockwise direction, which causes the moving gear 54 to mesh with the cam driving gear 47G. Consequently, the cam driving gear 47G rotates in the clockwise direction, and the cam 47 follows the rotation.

Figure 10:
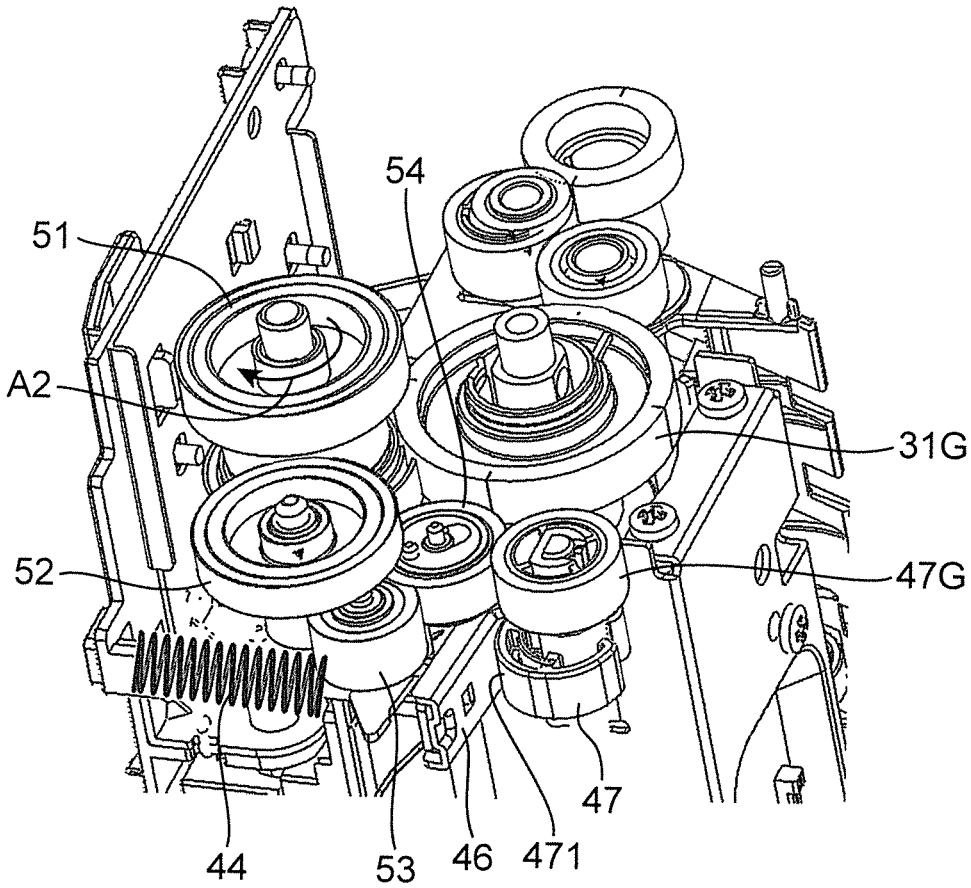
FIG. 10 is a perspective view illustrating an operation of the gear transmission mechanism.

FIG. 9 shows a state where the short radius part 472 of the cam 47 faces the lever 46. This state is previously described with reference to FIG. 6A, in which the first pressing spring 44 is expanded to exert a pressing force to the pressing roller 32 and thereby defines the fixing nip N1 in the normal pressure state. FIG. 10 shows a state where the long radius part 471 is in contact with the lever 46 as a result of a half revolution of the cam 47 from the position shown in FIG. 9. This state is previously described with reference to FIG. 6B, in which the first pressing spring 44 is compressed by the lever 46 and thereby defines the fixing nip N2 in the low pressure state. Therefore, it is possible to change the normal pressure state to the low pressure state and vice versa by imparting a torque to the driving input gear device 51 by the unit of a half revolution of the cam 47.

Figure 11:
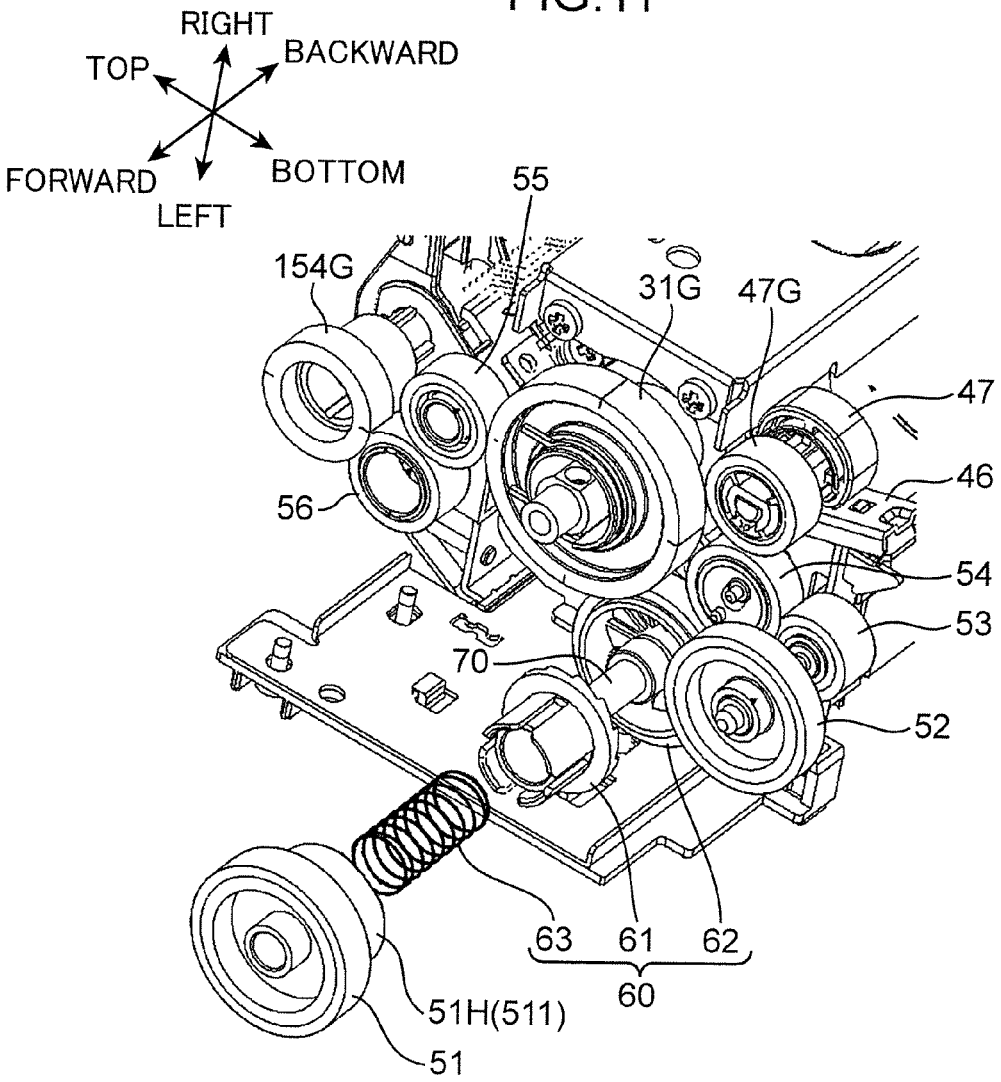
FIG. 11 is an exploded perspective view for explaining a ratchet mechanism.
Figure 12:
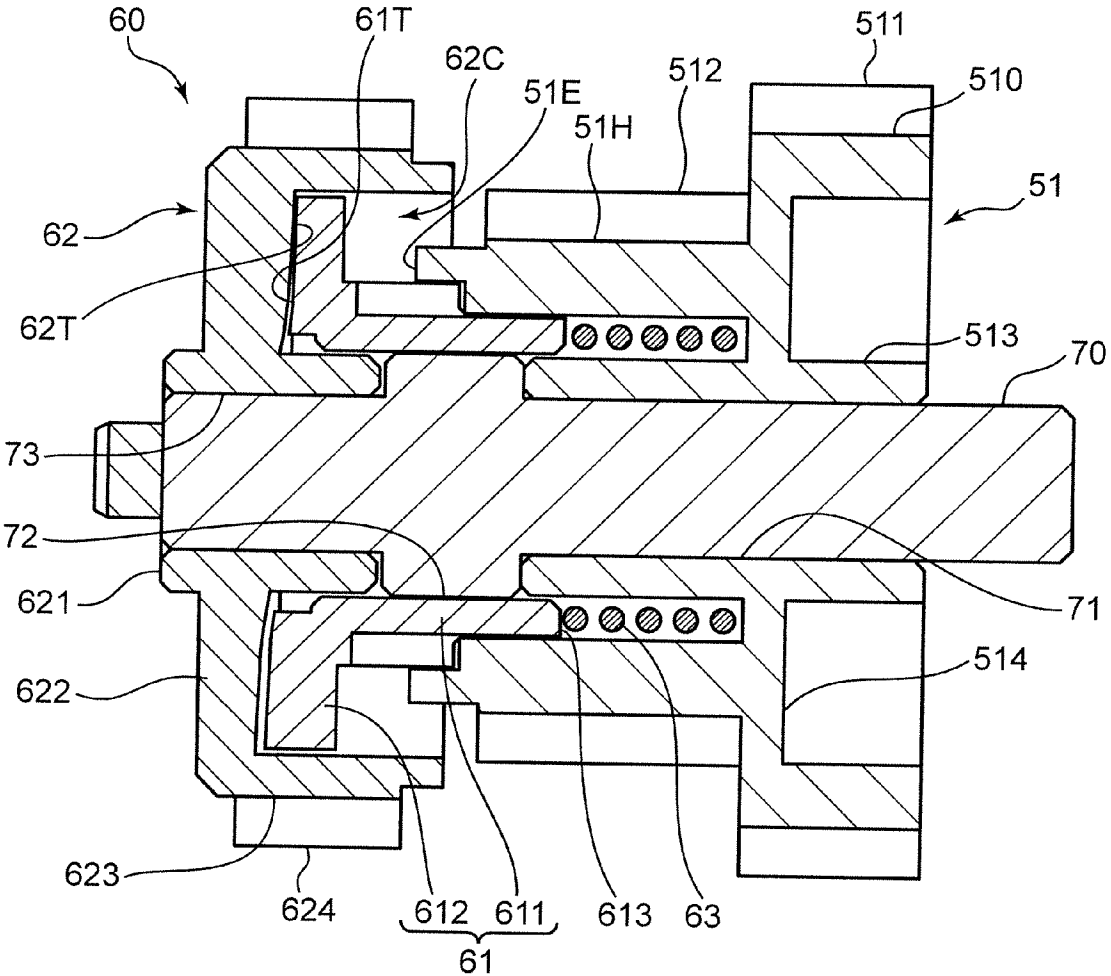
FIG. 12 is a sectional view of the ratchet mechanism.
Figure 13:
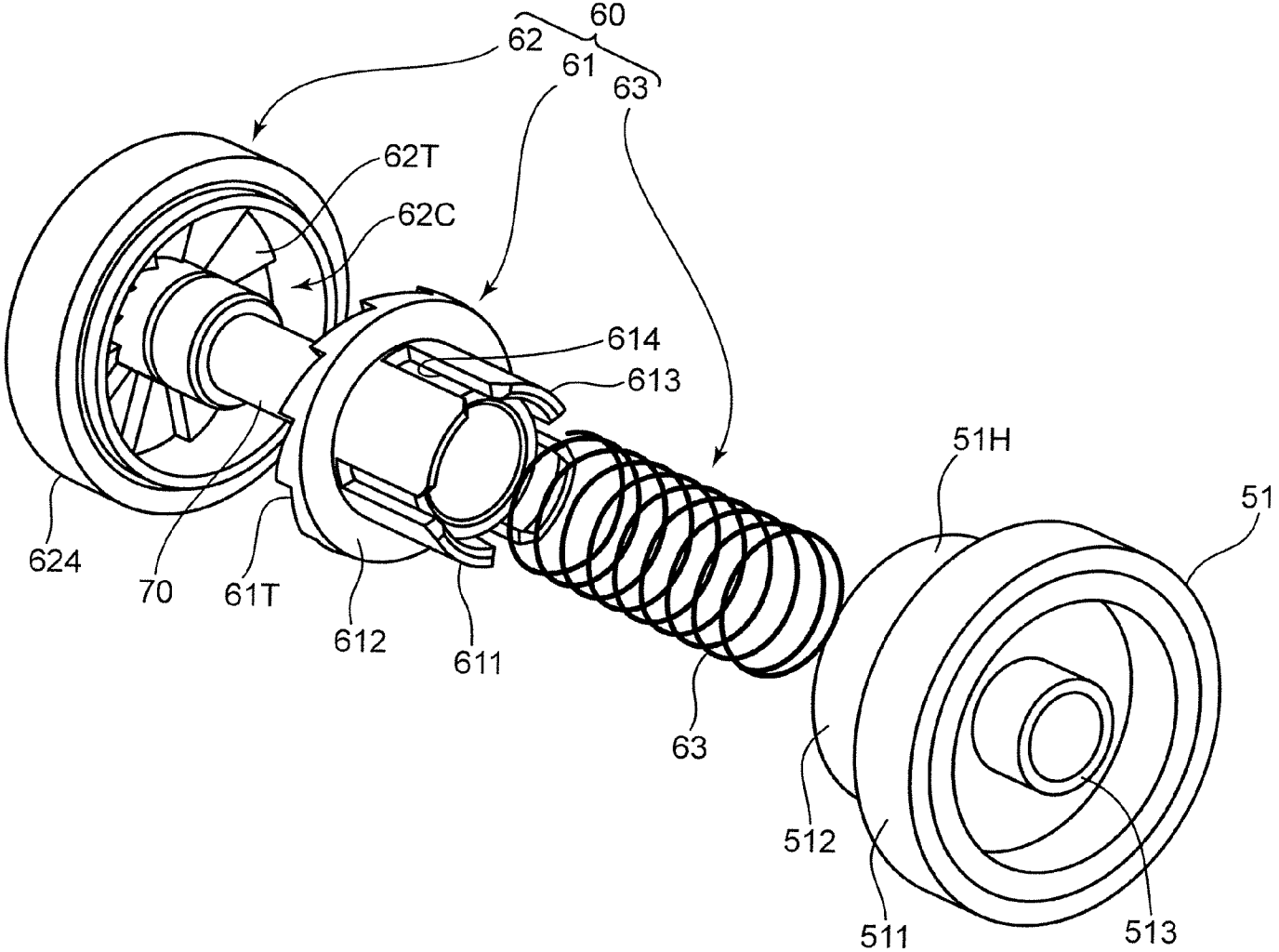
FIG. 13 is an exploded perspective view of a driving input gear device and the ratchet mechanism.
Figure 14:
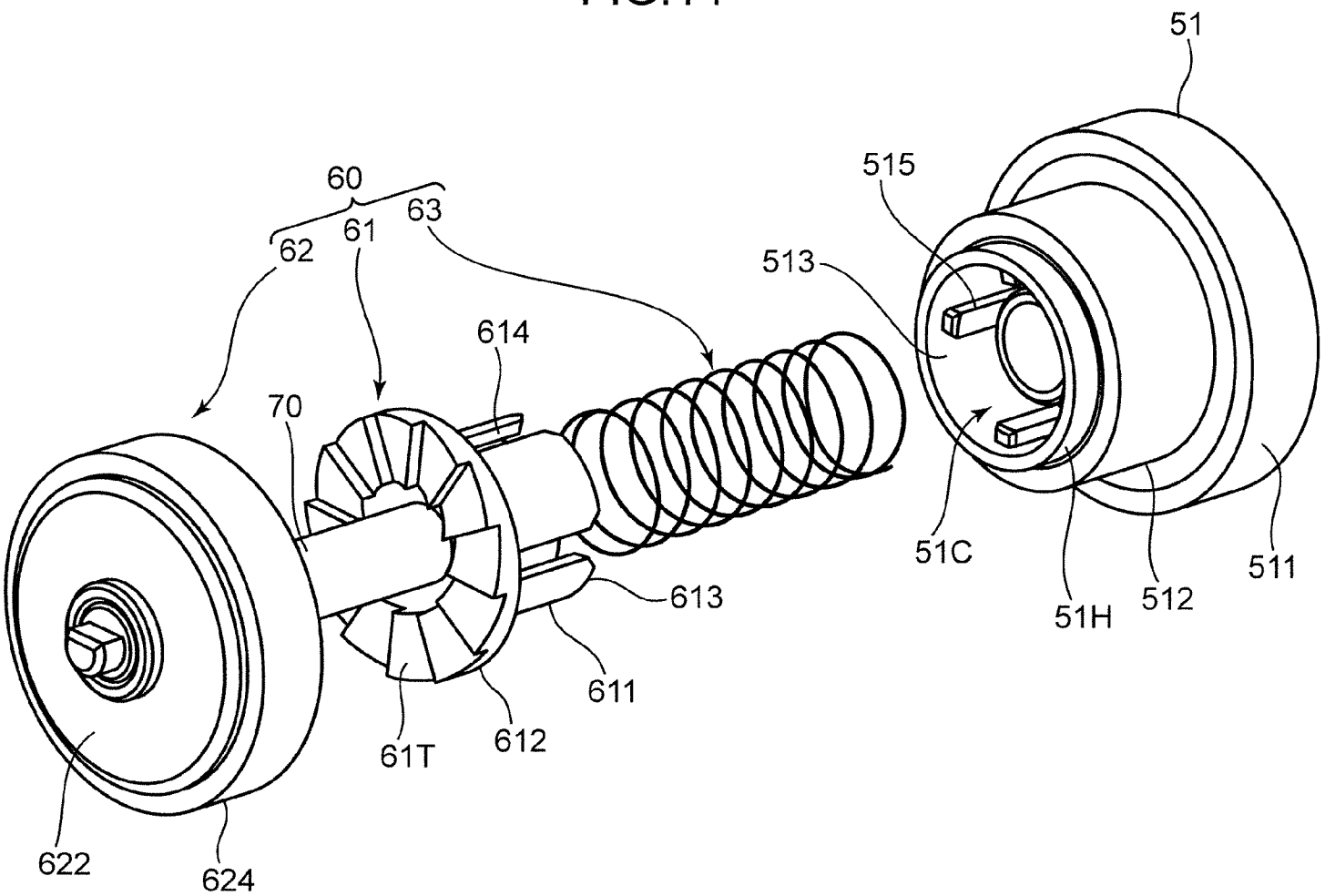
FIG. 14 is an exploded perspective view of the driving input gear device and the ratchet mechanism.

Now the driving input gear device 51 and the ratchet mechanism 60 will be described in detail with reference to FIGS. 11 to 14. FIG. 11 is an exploded perspective view for explaining the driving input gear device 51 and the ratchet mechanism 60. FIG. 12 is a sectional view of the driving input gear device 51 and the ratchet mechanism 60. FIGS. 13 and 14 each show an exploded perspective view of the driving input gear device 51 and the ratchet mechanism 60. The driving input gear device 51 and the ratchet mechanism 60 are mounted on a common support shaft 70 so as to be axially aligned with each other. The present embodiment is configured so as to, while employing the ratchet mechanism for transmitting only the torque of the specific direction to the roller gear 31G of the fixing roller 31, save space and, furthermore, reduce an unpleasant ticking sound as much as possible.

The driving input gear device 51 includes a large diameter portion 510 (FIG. 12) in the form of a cylinder, and the housing portion 51H in the form of a cylinder and having a smaller diameter than the large diameter portion 510 and axially joining the large diameter portion 510. First gear teeth 511 in the form of spur gear teeth are formed in an outer circumferential portion of the large diameter portion 510, and second gear teeth 512 (transmitting gear part) in the form of spur gear teeth are formed in an outer circumferential portion of the housing portion 51H. The driving input gear device 51 further includes a boss portion 513 in the form of a small diameter cylinder, the boss portion being disposed coaxially with the large diameter portion 510 and the housing portion 51H. A web portion 514 in the form of a disc connects the outer circumference of the boss portion 513 with the large diameter portion 510. One end of the housing portion 51H is connected to a side surface of the web portion 514. The boss portion 513 is rotatably fitted on a front end 71 of the support shaft 70. Therefore, the driving input gear device 51 rotates around an axis of the front end 71.

The ratchet mechanism 60 includes a ratchet joint 61, a ratchet gear 62, and a ratchet pressing spring 63 (biasing member). The ratchet joint 61 includes a body portion 611 in the form of a cylinder, and a base portion 612 in the form of a disc, the base portion being mounted on one end of the body portion 611. A surface of the other end 613 of the body portion 611 serves as a pressure surface for receiving a pressing force from the ratchet pressing spring 63. A first ratchet tooth portion 61T is formed in an end portion of the base portion 612, the first ratchet tooth portion including a plurality of ratchet projections sloping in a circumferential direction and disposed in a circle.

A plurality of slits 614 are formed in the body portion 611, the slits extending in an axial direction of the support shaft 70. On the other hand, linear protrusions 515 are formed on an inner circumferential surface of the housing portion 51H of the driving input gear device 51, the linear protrusion extending in the axial direction. The body portion 611 has an outer diameter slightly smaller than an inner diameter of the housing portion 51H, which allows substantially half of the body portion 611 to be placed in a cavity 51C of the housing portion 51H with the slits 614 being engaged with the linear protrusions 515. The body portion 611 is fitted on a central large diameter portion 72 of the support shaft 70 in a rotatable and axially movable manner. The ratchet joint 61 integrally rotates with the driving input gear device 51 by the engagement of the slits 614 and the linear protrusions 515.

The ratchet gear 62 includes a boss portion 621 in the form of a cylinder, a rim portion 623 (cylinder portion) in the form of a cylinder and having a diameter larger than the boss portion 621, and a web portion 622 (disc portion) connecting the boss portion 621 with the rim portion 623. The web portion 622 closes an opening at one end of the rim portion 623, and a circular cavity 62C is defined by an inner circumferential surface of the rim portion 623, an inner surface of the web portion 622, and an outer circumferential surface of the boss portion 621. The boss portion 621 is fitted on a rear end 73 of the support shaft 73 and secured thereon (D-cut fitting). Therefore, the support shaft 70 rotates together with the ratchet gear 62. On the other hand, although the ratchet joint 61 and the driving input gear device 51 are disposed coaxially with the ratchet gear 62, they do not rotate together with the support shaft 70.

Gear teeth 624 (gear part) are formed in an outer circumferential surface of the rim portion 623, the gear teeth being meshed with the roller gear 31G. A second ratchet tooth portion 62T is formed in an inner surface of the web portion 622. The second ratchet tooth portion 62T includes a plurality of ratchet projections each having a slope and disposed in a circle. The size and the pitch of the ratchet projections of the second teeth 62T are identical to those of the ratchet projections of the first ratchet tooth portion 61T.

The ratchet pressing spring 63 is in the form of a cylindrical coil spring for biasing the ratchet joint 61. The ratchet pressing spring 63 has such a diameter and length as to fit in an annular space defined between the boss portion 513 and the housing portion 51H of the driving input gear device 51. The ratchet pressing spring 63 is compressively fit between the web portion 514 of the driving input gear device 51 and the other end 613 of the body portion 611. The base portion 612 of the ratchet joint 61 is placed in the cavity 62C of the ratchet gear 62, with the first ratchet tooth portion 61T facing the second ratchet tooth portion 62T. The ratchet pressing spring 63 exerts a biasing force to thereby allow the first ratchet tooth portion 61T to continually press the second ratchet tooth portion 62T.

The first ratchet tooth portion 61T and the second ratchet tooth portion 62T engage with each other when the drive input gear device 51 receives the counterclockwise torque, and slide against each other when the driving input gear device 51 receives the clockwise torque. In the former case, the torque of the driving input gear device 51 transmitted to the ratchet joint 61 is transmitted to the ratchet gear 62, to thereby rotationally drive the roller gear 31G (fixing roller 31). On the other hand, in the latter case, the torque is not transmitted to the ratchet gear 62. However, because the first ratchet tooth portion 61T and the second ratchet tooth portion 62T are in constant contact with each other, a ticking sound is likely to occur due to the contact (sliding) of the respective ratchet projections.

In the present embodiment, the driving input gear device 51 and the ratchet mechanism 60 are incorporated and aligned with each other in the axial direction of the support shaft 70, with a part of the ratchet mechanism 60 being placed in the housing portion 51H of the driving input gear device 51. Specifically, as shown in FIG. 12, the housing portion 51H houses the substantially half portion of the body portion 611 of the ratchet joint 61, and the ratchet pressing spring 63, the half portion including the other end 613. In addition, the cavity 62C defined in the rim portion 623 of the ratchet gear 62 houses the remaining part of the body portion 611, and the base portion 612 including the first ratchet tooth portion 61T. In other words, the elements that function as a ratchet are disposed between the driving input gear device 51 and the roller gear 31G with efficient use of the space, which allows space saving.

Further, according to the present embodiment, the housing portion 51H and the rim portion 623 function as a barrier for absorbing a sound generated by the ratchet mechanism 60, which makes it possible to significantly reduce leakage of the ticking sound to the outside of the image forming apparatus 1. Specifically, the first ratchet tooth portion 61T and the second ratchet tooth portion 62T are in contact with each other in the cavity 62C of the rim portion 623, with the opening of the cavity 62C closed by an end surface 51E of the housing portion 51H and an end surface of the second gear teeth 512. This prevents the ticking sound unpleasant for a user from leaking out, which can contribute to low-noise operation of the image forming apparatus 1.

As described, the present embodiment makes it possible to provide the fixing device 30 including the nip pressure adjustment mechanism 40 for adjusting the fixing nip N, and the image forming apparatus 1 including the fixing device 30 which ensure space saving and reduction of unpleasant sound while using the ratchet mechanism as a transmission mechanism for transmitting only a torque of a specific direction.

Although the embodiment of the present disclosure has been described, the present disclosure is not limited to the above-described embodiment and, for example, the following modified embodiments may be adopted.

(1) In the above-described embodiment, the first roller is exemplified by the fixing roller 31 in the form of a metallic cylindrical roller, and the second roller is exemplified by the pressing roller 32 in the form of a roller and including an elastic layer. However, this is merely an example and, any combination of the first roller and the second roller may be employed as long as it allows the fixing processing. For example, it is possible to use the pressing roller 32 in the form of a metallic roller, and the fixing roller 31 in the form of an elastic roller that is an assembly body consisting of an elastic body and a fixing belt. Further, the fixing device 30 may use an induction heating system instead of an electric heating system.

(2) The above-described embodiment provides an example in which the pressing roller 32 is mounted on the movable pressing plate 41, and the fixing roller 31 is stationary. Alternatively, the fixing roller 31 may be mounted on the movable plate 41, while the pressing roller 32 may be made to be stationary. Further, the pressing roller 32 may serve as a driving roller, while the fixing roller 31 may serve as a driven roller.

(3) The above-described embodiment provides an example in which the engaged portion of the first ratchet tooth portion 61T and the second ratchet tooth portion 62T is placed in the cavity 51C of the housing portion 51H and the cavity 62C of the rim portion 623 of the ratchet gear 62 and enclosed by the housing portion 51H and the rim portion 623. Alternatively, the housing portion 51H may be axially extended so as to cover the engaged portion substantially only by the housing portion 51H. Further alternatively, the end surface 51E of the housing portion 51H may be provided with a flange so as to cover a larger area of the engaged portion.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

What is claimed is:

1. A fixing device, comprising:

first and second rollers defining a fixing nip and rotatable around respective their axes;

a roller gear for transmitting a torque to the first roller;

a pressure adjustment mechanism for performing posture change of changing from a first posture where the first and second rollers are in pressed contact with each other at a first pressure to a second posture where the first and second rollers are in pressed contact with each other at a second pressure lower than the first pressure, and vice versa;

a drive input gear device operable to receive a torque of a first rotational direction around an axis of the gear device and another torque of a second rotational direction opposite to the first direction;

a ratchet mechanism for, when the drive input gear device receives the torque of the first rotational direction, transmitting the torque of the first rotational direction to the first roller and for, when the drive input gear device receives the torque of the second rotational direction, suspending a torque transmission to the first roller; and a transmission mechanism for, when the drive input gear device receives the torque of the second rotational direction, exerting a driving force to the pressure adjustment mechanism to thereby allow the posture change, wherein the ratchet mechanism includes:

a ratchet joint having a first ratchet tooth portion and a body portion engaged with the drive input gear device, the ratchet joint being rotatable integrally with the drive input gear device;

a ratchet gear having a second ratchet tooth portion engageable with the first ratchet tooth portion when the drive input gear device receives the torque of the first rotational direction, and a gear part meshed with the roller gear, the ratchet gear being disposed coaxially with the ratchet joint; and a biasing member biasing the ratchet joint to thereby allow the first ratchet tooth portion to press the second ratchet tooth portion, and wherein the drive input gear device includes a housing portion that houses at least a part of the body portion of the ratchet joint and the biasing member.

2. A fixing device according to claim 1, wherein the ratchet gear includes a cylinder portion, and a disc portion closing an opening at one end of the cylinder portion, the second ratchet tooth portion being formed in an inner surface of the disc portion, and the gear part being formed in an outer circumferential surface of the cylinder portion, and the cylinder portion houses the first ratchet tooth portion and the remaining part of the body portion.

3. A fixing device according to claim 1, wherein the transmission mechanism includes a first transmitting gear, the housing portion is in the form of a cylinder and includes a transmitting gear part formed in an outer circumferential portion thereof, and the first transmitting gear is disposed with respect to the drive input gear device so as to mesh with the transmitting gear part.

4. A fixing device according to claim 3, wherein the pressure adjustment mechanism includes a cam mechanism for realizing the posture change, and a cam driving gear for receiving a driving force from the transmission mechanism to bring the cam mechanism into operation, and the transmission mechanism includes a second transmitting gear for receiving a torque via the first transmitting gear, the second transmitting gear being meshed with the cam driving gear when the drive input gear device receives the torque of the second direction, and being moved in a direction of disengaging from the cam driving gear when the drive input gear device receives the torque of the first rotational direction.

5. An image forming apparatus, comprising:

an image forming section for transferring a toner image onto a sheet; and the fixing device according to claim 1 for fixing the toner image on the sheet.

* * * * *